United States Patent [19]

Markham

[11] Patent Number: 4,627,132

[45] Date of Patent: Dec. 9, 1986

[54] BELT CLASP

[76] Inventor: Vivian C. Markham, 1490 Lowell Ct., Crofton, Md. 21114

[21] Appl. No.: 668,797

[22] Filed: Nov. 6, 1984

[51] Int. Cl.[4] ..... A44B 13/00

[52] U.S. Cl. ..... 24/169; 24/163 K; 24/343; 24/546

[58] Field of Search ..... 24/169, 170, 171, 194, 24/163 K, 198, 186, 200, 543, 546, 547, 67.9, 3 J, 3 M, 49, 343; 2/322; 40/21 C, 11 R

[56] References Cited

U.S. PATENT DOCUMENTS

| | | | |
|---|---|---|---|
| 186,314 | 1/1877 | Davis | 24/546 |
| 391,713 | 10/1888 | Hohenstein | 24/170 |
| 411,188 | 9/1889 | Gira et al. | 24/546 |
| 858,989 | 7/1907 | Keiser | 24/343 |
| 986,083 | 3/1911 | Perrine | 24/198 |
| 1,095,247 | 5/1914 | Toce | 24/343 |
| 1,206,074 | 11/1916 | Zwiener et al. | 24/343 |
| 1,854,092 | 4/1932 | Abronski | 40/21 C |
| 2,460,089 | 1/1949 | Johnson | 24/543 |
| 2,702,513 | 2/1955 | Tuttle | 24/169 |
| 2,843,900 | 7/1958 | Nye | 24/67.9 |
| 2,856,666 | 10/1958 | Crothers | 24/546 |
| 2,863,196 | 12/1958 | Shears | 24/543 |
| 3,369,278 | 2/1968 | Humphreys | 2/322 |
| 4,280,254 | 7/1981 | Racke | 24/163 K |

FOREIGN PATENT DOCUMENTS

| | | | |
|---|---|---|---|
| 275505 | 6/1930 | Italy | 24/171 |
| 6313 | of 1897 | United Kingdom | 24/198 |
| 214837 | 2/1924 | United Kingdom | 24/169 |

*Primary Examiner*—Victor N. Sakran

*Attorney, Agent, or Firm*—John B. Dickman, III

[57] ABSTRACT

A belt clasp for holding a loose belt end in place including a first leg and a second leg, where spring pressure holds the belt end in place.

1 Claim, 10 Drawing Figures

BELT CLASP

BACKGROUND OF THE INVENTION

The uncontrollable free end of a belt waving like a flag for all the world to notice is one of the singular most distracting concerns of a well dressed person. Considering the time and thought that goes into planning the right clothes and accessories, it is particularly unnerving to have all that effort undermined by a waving belt end.

At the present time, belt ends are held in place by belt loops which are fixed to the belt close to the belt buckle. There are some belt loops which freely slide on the belt to adjust to better hold the end of the belt. Since most belts are made of a material which has a slippery surface or is limp, it is difficult to keep the loose end in a belt loop. Part of the reason is that the loop does not grip the loose end but merely supports it.

Prior devices for keeping the loose end of a belt in place have included belt clasps which clip the belt end to the garment. The problem with such devices is that they do not do the job. Belt clasps, as stated, usually clip the belt and garment together which may cause the garment to gather or be pulled. Further, quite often, the clasp just does not grip the belt end sufficiently to prevent it from waving about.

The present invention is designed to provide a belt clasp that only clamps the end to the belt itself and is useable with different belts as a decorative item.

SUMMARY OF THE INVENTION

The invention relates to a belt clasp to hold the loose end of a belt in place, and in particular, to a belt clasp which only clamps the loose end of a belt to the belt itself.

The belt clasp has a belt hook which fits over the portion of the belt encircling a person's body and a portion for clamping the free end to the belt. In one version, the belt clasp is made of a spring biased material to pinch the loose end to the rest of the belt, and in another version, a hinged element has a spring for pinching the loose end against the belt.

DESCRIPTION OF THE INVENTION

Figure 1:
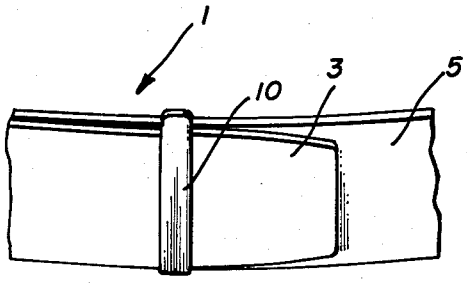
FIG. 1 is a front view of a belt clasp of the present invention.
Figure 1A:
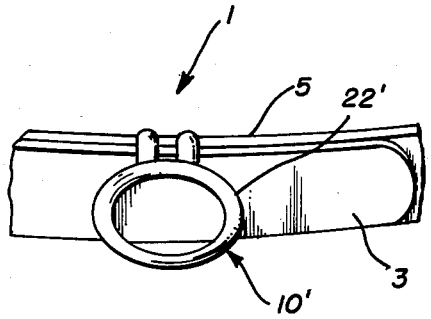
FIG. 1A is a front view of a second embodiment of the invention.
Figure 6:
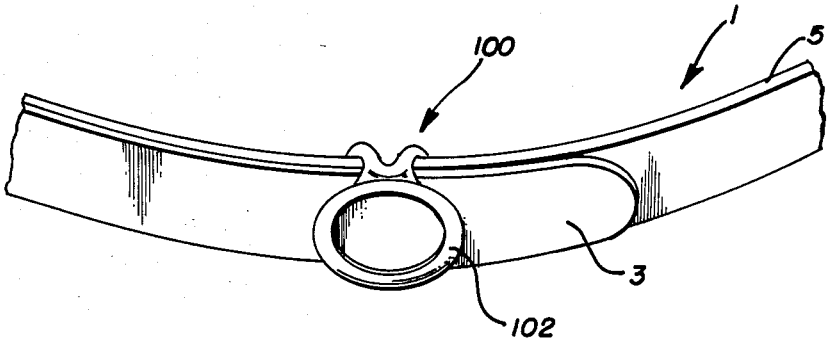
FIG. 6 is a front view of still another embodiment of the invention.

Referring to the drawings, there is shown in FIGS. 1, 1A and 6, front views of belt clasps of this invention. A belt 1 is shown having a loose end 3 held against the main body 5 by a belt clasp 10. Each of the belt clasp 10 has a grasping front element which presses the belt loose end 3 against the main body 5 and a belt supporting element.

Figure 2:
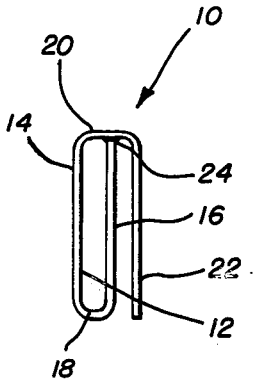
FIG. 2 is a side view of the belt clasp of FIG. 1.

In FIGS. 1 and 2, the belt clasp 10 has a belt supporting loop 12 which fits over a belt to slide to any desired position and a clamping leg 22. There are two legs 14 and 16 separated by ends 18 and 20. The end 20 extends beyond leg 16 and has a leg 22 for clamping the loose end 3 of a belt against the belt 1. The belt clasp 10 is made of a single piece of spring biased material such as steel or a plastic and is welded at 24 to form loop 12.

The belt clasp 10' in FIG. 1A is constructed like belt clasp 10 with a supporting loop 12, however, there may be two belt loops 12. The clamping leg is different in FIG. 1A to provide a decorative shape 22'.

Figure 4:
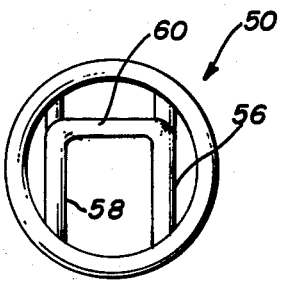
FIG. 4 is a front view of FIG. 3.
Figure 3:
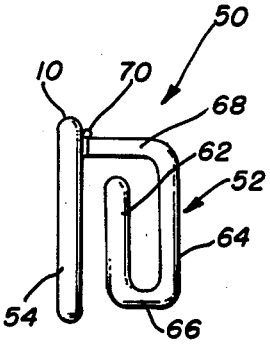
FIG. 3 is a side view of a third embodiment of the invention.
Figure 5:
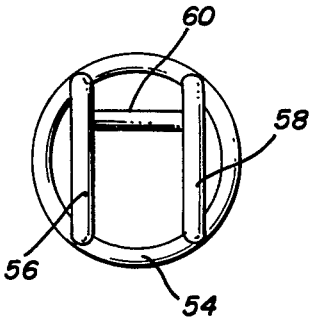
FIG. 5 is a back view of FIG. 3.

The belt clasp 50 in FIG. 3 has an open belt supporting loop 52 and a hinged clamping leg 54. The loop 52 is made with parallel members 56 and 58 bent in the shape of a U with a bridging arm 60 between the members as shown in FIGS. 4 and 5. In FIG. 3, the member 56 has a pair of parallel legs 62 and 64 separated by an end 66. Extending from leg 64 is an arm 68 which extends beyond leg 62. Clamping leg 54 is hinged to the end of arm 68 by a spring biased hinge 70 of the type which holds the leg 54 under tension. The clamping leg 54 is shown as a circular ring design however, any attractive design may be used.

To use the belt clasp 50, the loop portion 52 is slipped onto a belt 1 to any desired location where it will clasp the loose end 3. The clamping leg is pivoted to an open position and the belt loose end 3 is held against the main body 5. When the clamping leg 54 is closed, the loose end 3 is clamped in place by the force of the spring biased hinge pressing the clamping leg 54 and end 3 against main body 5.

Figure 9:
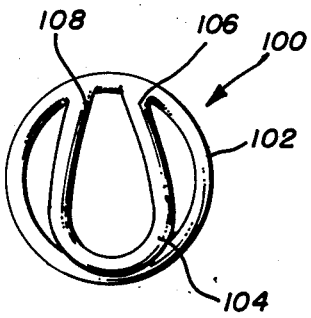
FIG. 9 is a back view of FIG. 6.
Figure 8:
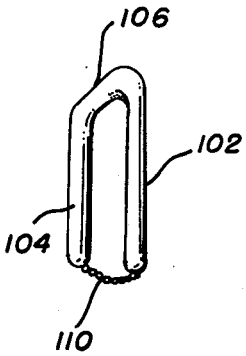
FIG. 8 is a side view of FIG. 6.
Figure 7:
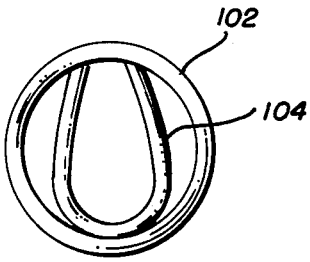
FIG. 7 is a front view of FIG. 6 without the belt present.

In FIG. 6, a third embodiment of a belt clasp of the invention is shown. The belt clasp 100 has a circular clamping leg 102 for pressing the belt loose end 3 against the belt main body 5. In FIGS. 7 and 9, the clamping leg 102 is integral with a spring biased leg 104 which has a looped shape with projecting portions 106 and 108 connecting to clamping leg 102. The leg 104 is made of a spring biased material which flexes to allow the belt clasp 100 to slip over the belt end 3 and main body 5 as in FIG. 6. To prevent the belt clasp 100 from sliding off belt 1, a safety chain 110 is provided, FIG. 8, to form a closed loop between the legs 102 and 104.

It should be appreciated that while several embodiments of the invention have been disclosed, one skilled in the art could by studying the invention, realize other embodiments. Therefore, for a full understanding, one should consider the invention in view of the drawings and description taken with the claims.

I claim:

1. A belt clamp for clamping the loose end of a belt against the body encircling portion of the belt to prevent the loose end from hanging, comprising a substantially U-shaped clasp having two legs and a connecting member, one of said legs being longer than the other and turned upon itself to form a third leg inside the U-shaped clasp and being parallel to the other two legs, the end of said longer turned in leg contacting the inner portion of the connecting member of the U and attached thereto to form a closed loop.

* * * * *